US008418689B1

(12) United States Patent
Davenport

(10) Patent No.: US 8,418,689 B1
(45) Date of Patent: Apr. 16, 2013

(54) EXHAUST AIR TRANSFER DEVICE FOR OPEN SYSTEM UNDERWATER DIVING

(75) Inventor: Steven Roy Davenport, Yukon, OK (US)

(73) Assignee: Davenport Innovations, Inc., Yukon, OK (US)

( * ) Notice: Subject to any disclaimer, the term of this patent is extended or adjusted under 35 U.S.C. 154(b) by 186 days.

(21) Appl. No.: 12/781,325

(22) Filed: May 17, 2010

Related U.S. Application Data

(60) Provisional application No. 61/179,620, filed on May 19, 2009.

(51) Int. Cl.

| | |
|---|---|
| ***B63C 11/02*** | (2006.01) |
| ***A62B 7/10*** | (2006.01) |
| ***A62B 19/00*** | (2006.01) |
| ***A62B 23/02*** | (2006.01) |

(52) U.S. Cl.
USPC ..... 128/201.27; 128/200.29; 128/205.12

(58) Field of Classification Search ..... 128/200.25, 128/200.29, 201.11, 201.26–201.28, 206.29, 128/205.12, 205.27, 206.22; 405/186, 187; 137/81.2, 512, 907, 908
See application file for complete search history.

(56) References Cited

U.S. PATENT DOCUMENTS

| | | | | |
|---|---|---|---|---|
| 3,415,245 | A | 12/1968 | Yamamato et al. | |
| 3,474,782 | A | 10/1969 | Cupp | |
| 3,568,672 | A | 3/1971 | Cupp | |
| 3,656,276 | A * | 4/1972 | Vind | 95/172 |
| 3,721,235 | A | 3/1973 | Ball et al. | |
| 3,867,115 | A | 2/1975 | Heintzelman | |
| 4,010,746 | A | 3/1977 | Pedersen | |
| 4,182,323 | A | 1/1980 | Pedersen | |
| 4,227,521 | A | 10/1980 | Hart et al. | |
| 4,284,169 | A | 8/1981 | Tullock | |
| 4,467,797 | A | 8/1984 | Franke | |
| 4,527,658 | A | 7/1985 | Payne | |
| 4,616,645 | A | 10/1986 | Pedersen et al. | |
| 4,784,129 | A | 11/1988 | Garraffa | |
| 5,035,238 | A | 7/1991 | Christianson | |
| 5,829,432 | A | 11/1998 | Semeia | |
| 6,053,967 | A | 4/2000 | Heilmann et al. | |
| 6,089,225 | A | 7/2000 | Brown et al. | |
| 6,354,291 | B1 | 3/2002 | Brown et al. | |
| 6,644,307 | B2 | 11/2003 | Morgan et al. | |
| 6,666,210 | B2 | 12/2003 | Semeia | |
| 6,681,766 | B1 | 1/2004 | Matsuoka | |
| 6,983,746 | B2 | 1/2006 | Morgan et al. | |
| 7,266,958 | B2 | 9/2007 | Milde et al. | |
| 2004/0003811 | A1 | 1/2004 | Bodner | |
| 2004/0035415 | A1 | 2/2004 | Faligant | |
| 2005/0235989 | A1 | 10/2005 | Morgan et al. | |
| 2006/0118109 | A1 | 6/2006 | Sato et al. | |
| 2006/0272637 | A1 | 12/2006 | Johnson | |
| 2007/0062524 | A1 | 3/2007 | Morgan et al. | |

* cited by examiner

*Primary Examiner* — Jackie Ho
*Assistant Examiner* — Mark K Han
(74) *Attorney, Agent, or Firm* — Hall Estill Attorneys at Law

(57) ABSTRACT

Apparatus for use during open system diving to support underwater human respiration. In accordance with various embodiments, an air supply provides a supply of air along a supply conduit. A regulator is adapted for engagement with a diver's mouth to receive air from the supply during an inhale cycle and to direct a mixture of water and exhaust air away from the diver along an exhaust conduit during an exhale cycle. An air/water separator separates the exhaust air from the water in said mixture and directs the separated exhaust air through an exhaust air port. In some embodiments, a one-way stop valve is provided within the air/water separator to prevent back flow. In further embodiments, a bubble diffuser emits the exhaust air as a fine mist of bubbles into the surrounding water.

22 Claims, 16 Drawing Sheets

EXHAUST AIR TRANSFER DEVICE FOR OPEN SYSTEM UNDERWATER DIVING

RELATED APPLICATION

The present application makes a claim of domestic priority under 35 U.S.C. §119(e) to U.S. Provisional Patent Application No. 61/179,620 filed May 19, 2009, which is hereby incorporated by reference.

BACKGROUND

Self-contained, underwater breathing apparatus (SCUBA) equipment is used by professional divers, military personnel, and amateur enthusiasts the world over to survive and maneuver underwater for extended periods of time. Such systems often employ a portable source of pressurized air, such as one or more tanks, and associated regulators, lines, mouthpiece, mask, etc. to enable the diver to comfortably breathe air at depths of 100 feet underwater or more.

A problem often associated with open system SCUBA equipment is the exhaust air breathed out by the diver after each breath. This exhaust air normally exits the regulator assembly adjacent the diver's mouth as a large grouping of bubbles that float upward to the surface (hence, "open system" SCUBA). Depending upon the spatial orientation of the diver, the exhaust bubbles can pass directly adjacent the diver's ear, which can be unpleasantly loud and annoying to the diver and can detract from the serenity that the diver might have otherwise enjoyed in the underwater environment. Bubbles passing in front of the diver's mask can also obscure vision and may in some instances cause a safety risk.

Expansive underwater environments, such as that existing under the surface of an ocean, can often have an "ambient" noise level made up of broad-spectrum "white" noise. While this noise can come from a variety of sources such as surface phenomena (e.g., wind, rain) and undersea animal life, a significant proportion of this white noise can often be attributed to bubbles of gas suspended within the water.

Undersea bubbles can be generated in a variety of ways, such as from the natural aeration provided by waves and currents, gasses from animals and plants, and methane or other gasses emitted into the water from underlying strata. This high frequency white noise often represents a normal background level for undersea life, in much the same way that high frequency noise from overhead UV lights or HVAC conduits are not usually noticed by human workers in an office building.

Noise vibrations can be generated when bubbles are formed, when a group of smaller bubbles coalesce into a larger bubble, and when a larger bubble collapses into a group of smaller bubbles. Bubbles also emit noise vibrations when they reach the water surface and the entrapped gas escapes into the atmosphere. It has been found that different sizes of bubbles produce different frequencies when they collapse, and the collapse of different sizes of bubbles release different levels of energy into the surrounding water.

As an extreme case, the so-called Snapping Shrimp (*Alpheus heterochaelis*) can hunt prey by snapping a specialized claw shut to collapse a cavitation bubble and release large amounts of energy sufficient to stun or kill a small fish. The energy level is so great that sonoluminescence (light generation) and temperatures of around 5,000 degrees Kelvin are produced during the cavitation event.

It follows that, under normal circumstances, undersea wildlife are largely undisturbed by high-frequency, low energy noise conditions, but may become startled and skittish in the presence of lower-frequency, higher energy noise conditions. Unfortunately, when a human diver exhales through existing regulators, large, quickly forming bubbles are produced, and these bubbles release low-frequency energy of the type that tends to scare off wildlife when the diver approaches. By contrast, it has been observed that free divers and divers using closed-circuit rebreathers in which no bubbles are released can normally approach and get very close to wildlife.

SUMMARY

Accordingly, various embodiments of the present invention are generally directed to an improved exhaust air transfer device for open system underwater diving.

In accordance with some embodiments, an exemplary device comprises an air supply which provides a supply of air along a supply conduit. A regulator is adapted for engagement with a diver's mouth to receive air from the supply conduit during an inhale cycle and to direct a mixture of water and exhaust air away from the diver along an exhaust conduit during an exhale cycle. An air/water separator (AWS) is coupled to the exhaust conduit to separate the exhaust air from the water in said mixture and to direct the separated exhaust air along an exhaust air conduit.

In further embodiments, the exemplary device incorporates a bubble diffuser coupled to the exhaust air conduit which passes the separated exhaust air as a fine mist of bubbles into the surrounding water. The bubble diffuser may be located on the air supply, such as a tank affixed to the back of the diver. The bubble diffuser may be hinged to generally maintain the diffuser within a desired attitude range irrespective of the attitude of the diver. Alternatively, the bubble diffuser may be a "snorkel-type" member that projects upwardly from the air-water separator and away from the diver's face.

These and other features and advantages of various embodiments can be understood from a review of the following detailed description in conjunction with a review of the accompanying drawings.

BRIEF DESCRIPTION OF THE DRAWINGS

FIGS. 5-1 and 5-2 schematically depict a bubble diffuser of the breathing system in accordance with some embodiments.

DETAILED DESCRIPTION

Figure 1:
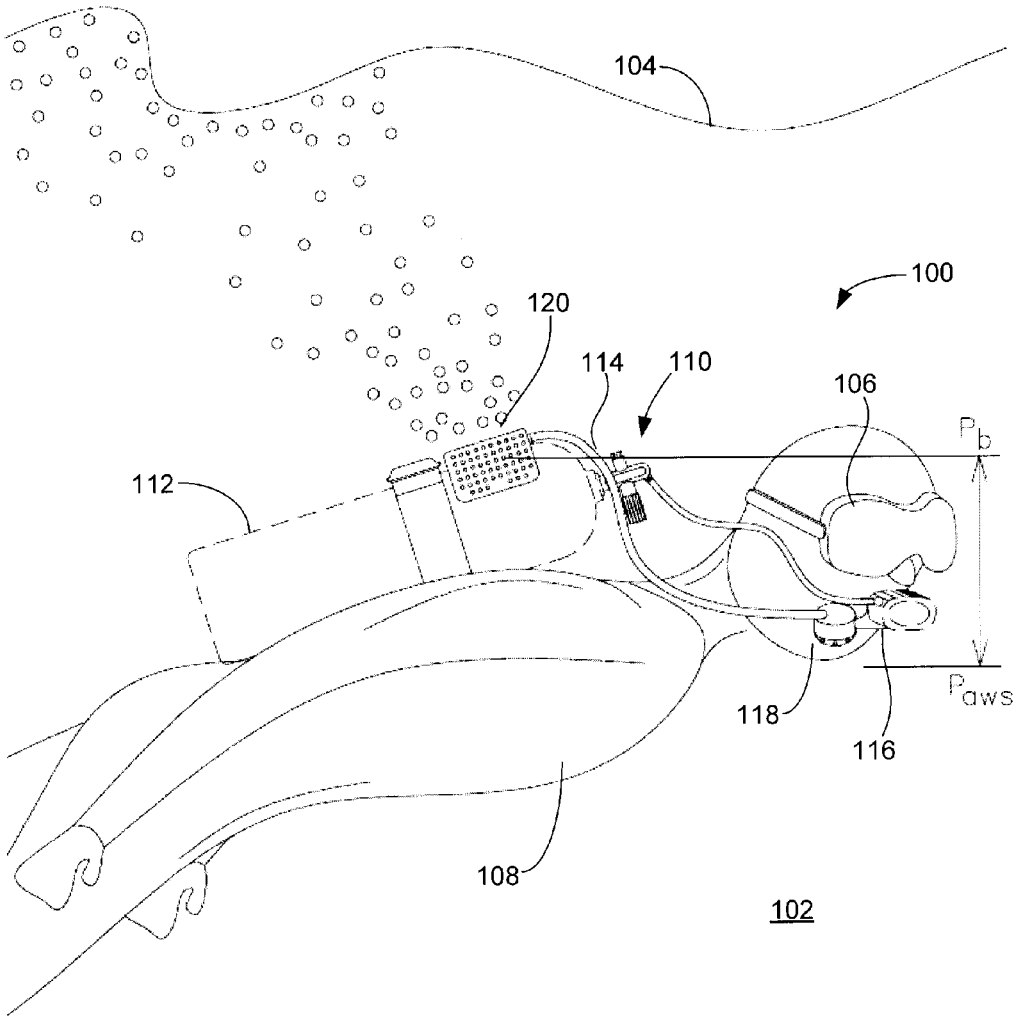
FIG. 1 shows a diver engaged in open system SCUBA diving in accordance with various embodiments of the present invention.

Various embodiments of the present invention are generally directed to an underwater breathing system having specially configured exhaust air transfer characteristics. FIG. 1 generally illustrates a human diver 100 submerged in a body of water 102 below a surface 104 thereof. The diver 100 is represented as engaging in open scuba diving with various accoutrements including a dive mask 106 and wetsuit 108. For ease of reference, the diver will be referred to as a male diver, although such is clearly not limiting.

The diver 100 employs an underwater breathing system 110 to provide a self-contained supply of air for the diver to breathe while he remains below the surface 104. The exemplary breathing system 110 incorporates a number of elements which are functionally represented in FIG. 2. These elements include a supply of pressurized air from an air source such as tank 112, an associated first stage (stage-1) regulator 114, a second stage (stage-2) regulator 116, an air/water separator (AWS) 118, and a bubble diffuser (bubbler) 120. Other arrangements can readily be used.

The stage-1 regulator 114 is mounted to the tank 112 and operates to reduce an initial pressure of the compressed air within the tank to a secondary lower pressure. An exemplary initial pressure may be on the order of about 3,000 pounds per square inch, psi, and an exemplary secondary pressure may be on the order of about 150 psi. The tank 112 and regulator 114 may be of a conventional type and are strapped to the back of the diver by way of a buoyancy compensator (BC) vest. Other scuba arrangements may readily be used, including the use of an air hose from a source above the surface 104.

The stage-2 regulator 116 takes a substantially conventional configuration except as modified as required to accommodate various aspects of the exemplary system 110 explained herein. The regulator 116 is held in the diver's mouth to receive air from the air tank 112 and stage-1 regulator 114.

During normal respiration, the diver breathes in fresh air from the air tank 112 through the regulator 116, and breathes out exhaust air through the regulator 116 to the downstream elements 118 and 120. Those skilled in the art will appreciate that the regulator generally includes a series of valves which respond to changes in the pressure of the ambient water in relation to the depth of the diver, the pressure exerted by the diver in breathing in fresh air from the tank, and the pressure exerted by the diver in breathing out the spent exhaust air from his lungs.

In the prior art, the spent exhaust air often exits various ports in the body of the regulator adjacent the diver's face, leading to decreased visibility and increased noise. This can be understood with reference to FIG. 3, which is a simplified functional diagram of an exemplary stage-2 regulator 116 configured as used in the related art. It will be appreciated that various styles and types of regulators are known with a number of additional features and functions not depicted in FIG. 3. Nevertheless, FIG. 3 is operable to set forth general features common to typical regulators of the existing art, as well as for regulators adapted for use in the system 110 of FIG. 2.

Figure 3:
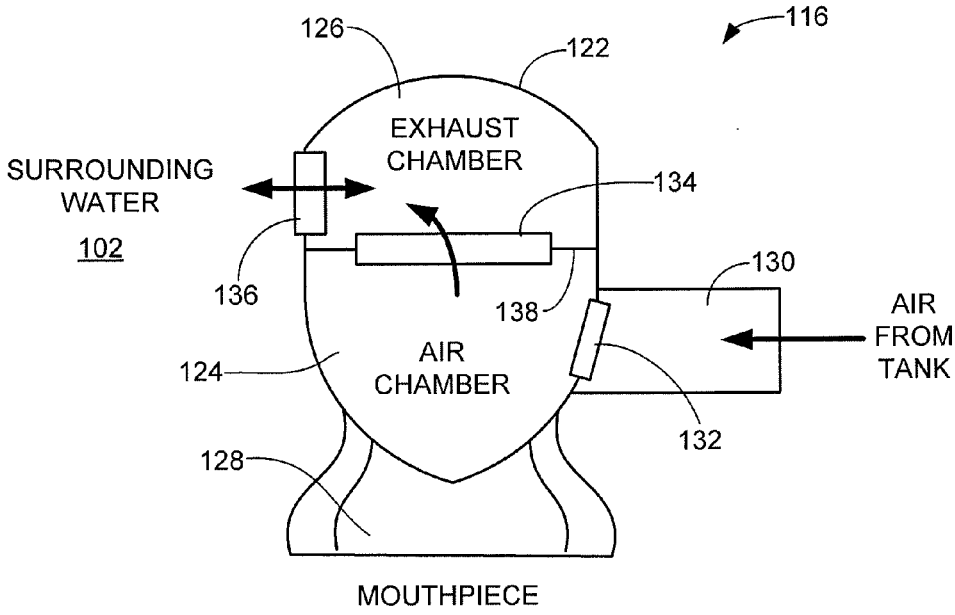
FIG. 3 is a schematic representation of a stage-2 regulator of the breathing system in accordance with some embodiments.

In FIG. 3, the regulator 116 is shown to have a housing (body) 122 divided into at least two chambers which are referred to herein as an air chamber 124 and an exhaust chamber 126. The air chamber 124 is coupled to a mouthpiece 128 configured for placement in the diver's mouth, and receives air from an air source via an inlet conduit 130. A pressure differential actuated air valve 132 selectively opens to admit a flow of pressurized air into the diver's lungs as the diver inhales. The air valve 132 is intended to remain closed at all other times. In at least some styles of regulators, the cracking pressure at which this valve opens can be manually adjusted by the diver during operation.

A main valve 134 is disposed between the air chamber 124 and the exhaust chamber 126. The valve 134 can take the form of a thin rubber membrane which operates as a one-way check valve. As with the valve 132, the valve 134 opens in a single direction when the diver breathes out so that the exhaust air passes through the air chamber 124 to the exhaust chamber 126, and out an exhaust port (or ports) 136 directly into the surrounding water.

Because the exhaust chamber 126 and the port(s) 136 are open to the surrounding water, these elements are typically full of water except when injected with the exhaust air from the diver's lungs when the diver breathes out. When the pressure of the exhaled air falls below the pressure of the surrounding water, the valve 134 closes and the valve 132 opens as the diver takes his next breath. It can be seen from FIG. 3 that the exhaust port is adjacent the mouthpiece 128, and hence the exhaust mixture of water and air flowing out the exhaust ports may pass directly adjacent the diver's mask and ears.

An adjustment mechanism may be provided to permit the diver to adjust the setpoint, or "cracking pressure" at which the valve 132 opens during inhaling. Such adjustments may be made by the diver by turning a spring biased knob (not separately shown). Generally, a higher cracking pressure requires the diver to exert greater force in inhaling to open the valve and allow the supply air to enter the air chamber 124, whereas a lower cracking pressure allows the diver to inhale air with less effort.

As will be appreciated by those skilled in the art, the valve 134 generally closes in relation to the pressure differential between the exhaust chamber 126 and the air chamber 124; that is, the system uses water pressure in the exhaust chamber 126 to close the valve 134 at the conclusion of each exhale cycle.

In some embodiments the valve 134 is characterized as a thin-film, disc shaped elastomeric membrane with a central portion rigidly affixed to a central dividing wall 138 of the housing that separates the respective chambers 124, 126. A circumferentially extending outer portion of the membrane covers one or more ports (not shown) that extend through the dividing wall.

This outer portion of the membrane is displaced away from the central wall 138 when the pressure in the air chamber 124 is greater than that of the exhaust chamber 126, thereby allowing the air to flow through said ports to the exhaust chamber 126. When the water pressure exceeds the pressure of the exhausted air, the water pressure in the exhaust chamber pushes this outer portion of the valve 134 into a water-tight sealing engagement against said wall 138, thereby closing off the fluidic communication between the respective chambers 124, 126. It will be appreciated that other valve configurations can readily be utilized.

A free-flow condition can arise if there is insufficient pressure differential to close the valve 134 before valve 132 opens. In a free-flow condition, air from the inlet conduit 130 will pass directly through the respective valves 132, 134 and out the port(s) 136. A free-flow condition can be remedied by increasing the setpoint pressure of valve 132. However, during such free-flow conditions large volumes of the stored air can escape to the surrounding water, reducing the available supply of air for use by the diver.

Figure 2:
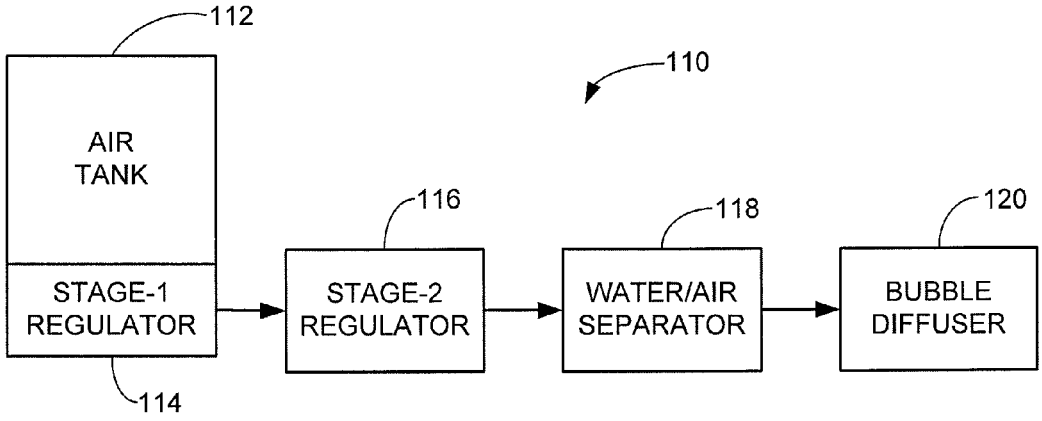
FIG. 2 is a functional block representation of various components of an underwater breathing system used by the diver in FIG. 1.
Figure 4:
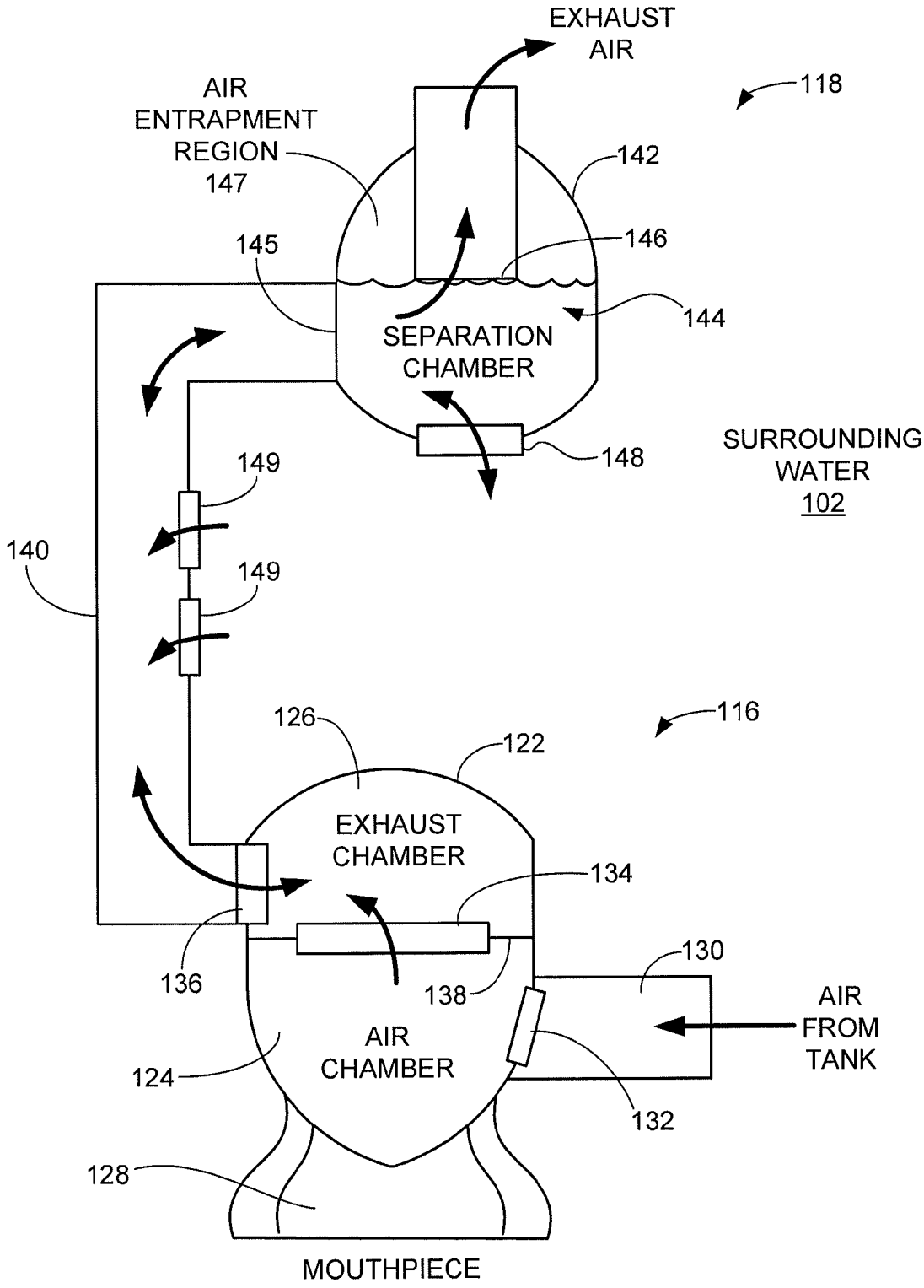
FIG. 4 is a schematic representation of the stage-2 regulator in conjunction with an air/water separator (AWS) of the breathing system in accordance with some embodiments.

FIG. 4 shows the regulator 116 of FIG. 3 configured for use in the system 110 of FIGS. 1 and 2 in accordance with some embodiments. In FIG. 4, a suitable adapter 140 matingly seals the port(s) 136 so that the exhaust air from the exhaust chamber passes along the adapter to the air/water separator 118. While the adapter 140 is shown to have substantial length in FIG. 4, this is merely for purposes of illustration; it is contemplated that the adapter 140 will be relatively short so that the air/water separator 118 is as close to the regulator 116 as practical, and is maintained close to the elevational depth of the main check valve 134. In some embodiments the adapter 140 is configured to mate with an existing regulator body 122, whereas in other embodiments the configuration of the regulator body is modified to integrally incorporate the adapter 140.

The air/water separator 118 includes a housing (body) 142 that defines an interior air/water separator chamber 144. An inlet port 145 receives the exhaust mixture of water and air from the adapter 140 and injects the same into the chamber 144. Although not shown in FIG. 4, the chamber 144 can be configured with appropriate baffle surfaces such that agitation takes place in the flow of the inlet air/water mixture. The exhaust air from the inlet mixture exits through an exhaust air exit port 146, and the exhaust water exists through one or more exhaust water exit ports 148. The air exit port 146 transmits the exhaust air to the bubble diffuser 120 (FIGS. 1-2) in a manner explained below.

The water exit port 148 is in fluidic communication with the surrounding water. This allows a two-way flow of water between the surrounding water and the separator chamber 144, as well as with the adapter 140 and the exhaust chamber 126 in the regulator 116. It is contemplated that during an exhale operation, water may be directed from the chamber 144 to flow out into the surrounding water, and water may flow back into the chamber 144 at the conclusion of each exhale operation. Although not shown in FIG. 4, adjustment mechanisms can be provided to regulate the effective port size of the port(s) 148 to adjust the flow of water therethrough.

In some embodiments, the top of the inlet port 145 is nominally aligned with the bottom of the air outlet port 146, which extends into the interior chamber 144 a selected distance as shown. This provides an air entrapment region 147 that surrounds the outlet port 146 and retains a volume of pressurized exhaust air. The entrapped air may cause the level of water within the chamber 144 to normally reach a steady state level between exhale cycles that is substantially level with the port 146, as shown.

In this way, as the diver exhales a breath, the force required by the diver during such exhalation may be relatively low; that is, just enough to lower the water level to uncover the port 146, thereby allowing the exhaust air to flow freely from port 145 to port 146 and out of the air/water separator 118. A slightly greater exhalation force may be required if the chamber 144 is completely filled with water, since the diver will need to vacate a larger amount of water from the chamber 144 to establish an atmospheric communication path between the respective ports 145, 146. Even if the chamber 144 is completely filled with water, however, it is contemplated that the diver will still be able to exhale easily and without noticeable effort.

Depending on the interior configuration of the chamber 144 and the orientation of the chamber during operation, at various times the chamber may be substantially filled with air, substantially filled with water, or may hold various respective amounts of air and water. In all cases, easy controlled respiration by the diver will be accommodated.

The air/water separator 118 can be mounted to the adapter 140 via a swivel so as to maintain a substantially constant upright vertical orientation irrespective of the orientation of the stage-2 regulator 116. In other embodiments, the air/water separator 118 can be rigidly affixed to the stage-2 regulator so that the orientation of the chamber 144 is set by the orientation angle of the regulator. It has been found that the air/water separator will function properly in substantially all orientations, even when upside down, as the exhaust air can readily flow out the port(s) 148 in this latter condition. However, it is contemplated that optimal results may be obtained when the chamber 144 is oriented along a range from upright vertical to horizontal.

Of particular interest is the flow of the exhaust water through the air/water separator. It will be recalled that the main check valve 134 opens and closes in relation to the differential pressure between the respective chambers 124 and 126. It is generally desirable that water flow into the exhaust chamber 126 at the conclusion of each exhale cycle to prevent initiation of a free-flow condition.

The adapter 140 and air/water separator 118 can be readily configured such that sufficient water is present to immediately fill the chamber 126 at the conclusion of each exhale cycle. To further ensure this fluidic flow, in at least some embodiments one-way check valves 149 may be provisioned in the adapter 140. These valves 149 remain closed when the mixture of water and air pass from the adapter 140 to the chamber 144 during an exhale cycle, and then immediately open at the end of each exhale cycle to permit a back flow of water into the exhaust chamber 126.

Preliminary test results have indicated that the force required to exhale air from the mouthpiece 128 and through an air/water separator such as 118 may be less than that required in a conventional regulator setup as in FIG. 3. In some cases it has been found that differential pressures sufficient to allow free flow in a conventional regulator setup as in FIG. 3 do not readily induce free-flow in the configuration of FIG. 4. Lower cracking pressures at the valve 132 can thus be used, leading to easier respiration by a diver during operation.

A variety of air/water separator configurations can be employed. Exemplary configurations include cylindrical, spherical, and tortuous path configurations. The relative locations of the inlet 146 and outlet 148 can be established to ensure that the exhaust air flows freely regardless of attitude, orientation angle, or relative depths of the regulator 116 and air/water separator 118.

As noted above, the exhaust air during each exhale cycle passes from the air/water separation chamber 118 through the exhaust air port 146 to the bubble diffuser 120. In some embodiments, the bubble diffuser 120 is located on the tank 112 on the diver's back. It will be appreciated that the use of the bubble diffuser with the air/water separator is not necessarily required; for example, in an alternative embodiment a conduit can extend from the air exhaust port 148 in a direction away from the diver's head and terminate in a one-way check valve. In such case, the exhausted air can exit into the surrounding water without the use of a diffusion structure to form a fine mist 151 of bubbles.

Figures 1, 5:
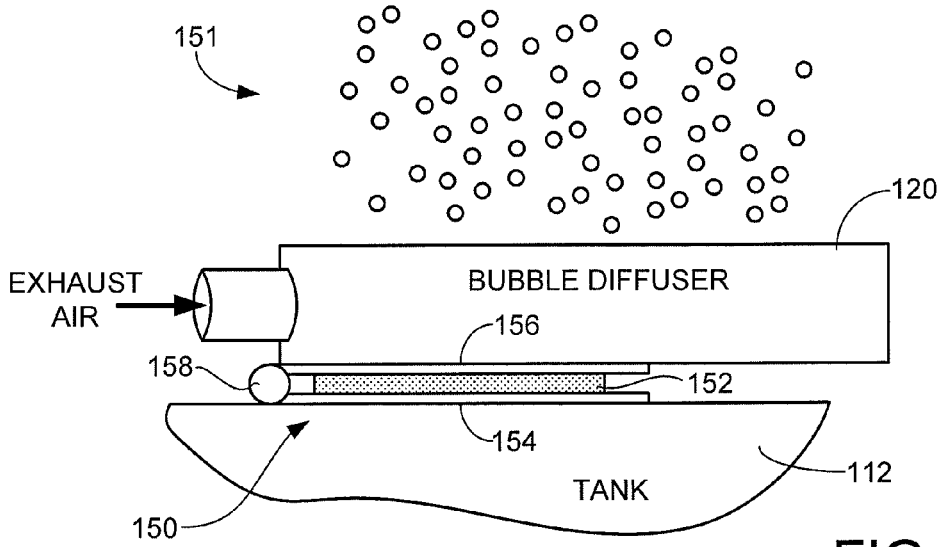
Figures 2, 5:
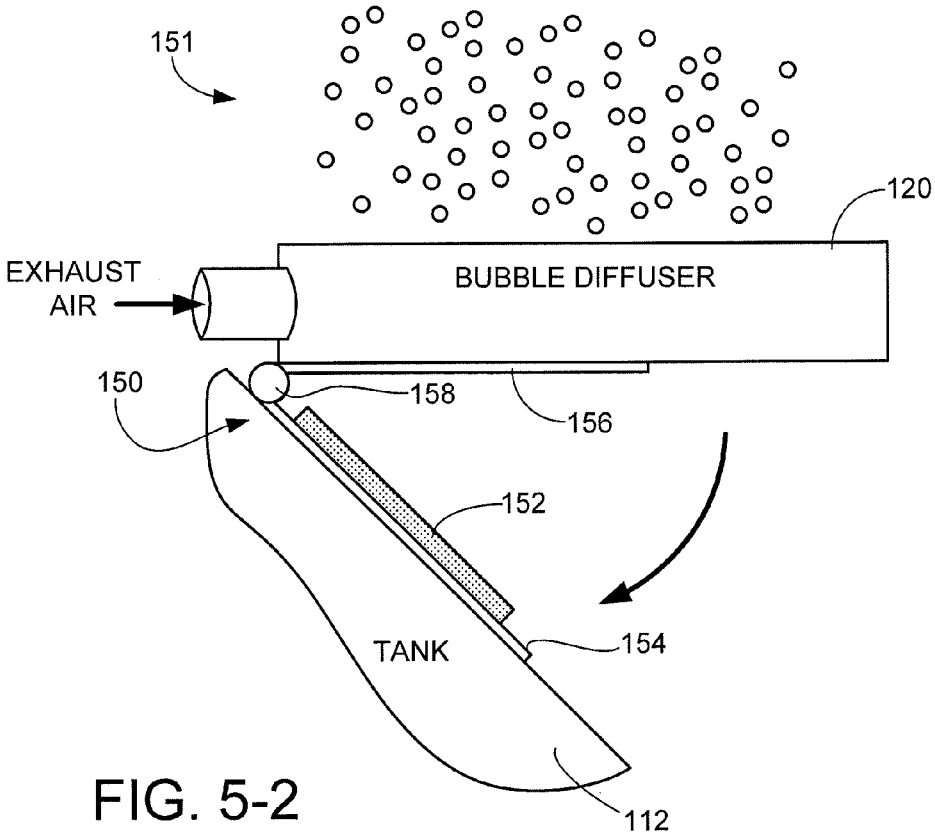

FIGS. 5-1 and 5-2 generally illustrate the exemplary bubble diffuser 120 to incorporate a hinge assembly 150. The bubbler 120 can be mounted to the tank 112 via a circumferentially extending strap 152 which is shown in cross-section. The strap rigidly secures a first hinge plate 154 of the hinge assembly 150 to the tank 112. A second hinge plate 156 can be secured to the underside of the bubbler housing, as shown. An intermediary hinge pin arrangement 158 facilitates relative rotation of the second hinge plate 156 with respect to the first hinge plate 154, so that the bubbler 120 is cantilevered at one end and rotates relative to the tank 112. In this way, the buoyancy of the bubbler housing and the enclosed air flowing therethrough will generally tend to maintain the bubbler 120 in a level orientation irrespective of changes in the rotational orientation of the diver.

Figure 5A:
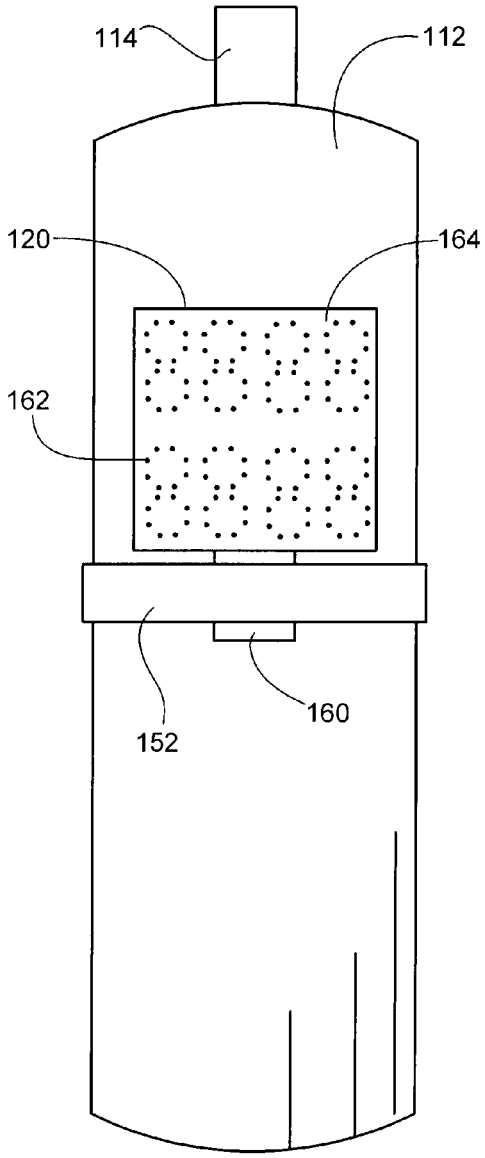
FIGS. 5A-5E illustrate alternative attachment configurations for the bubble diffuser.

FIG. 5A shows an alternative mounting configuration for the bubbler 120 onto the tank 112. The embodiment of FIG. 5A, and those that follow, can incorporate the hinge assembly 150 of FIG. 5 as desired. The bubbler 120 in FIG. 5A includes a tab 160 that extends from the bubbler housing and passes underneath the strap 152. Preferably, the bubbler housing is placed at or near the center of gravity of the diver 100, thereby having a substantially neutral effect upon diver maneuverability. This placement also locates the mist of bubbles a significant distance from the ears and eyes of the diver.

FIG. 5A further shows the diffusion structure to include an array of small exhaust apertures 162 that extend through an upper surface 164 of the bubbler 120. These apertures 162 permit passage of the air into the surrounding water as the aforementioned mist. Any suitable arrangement of apertures can be used as desired.

Figure 5B:
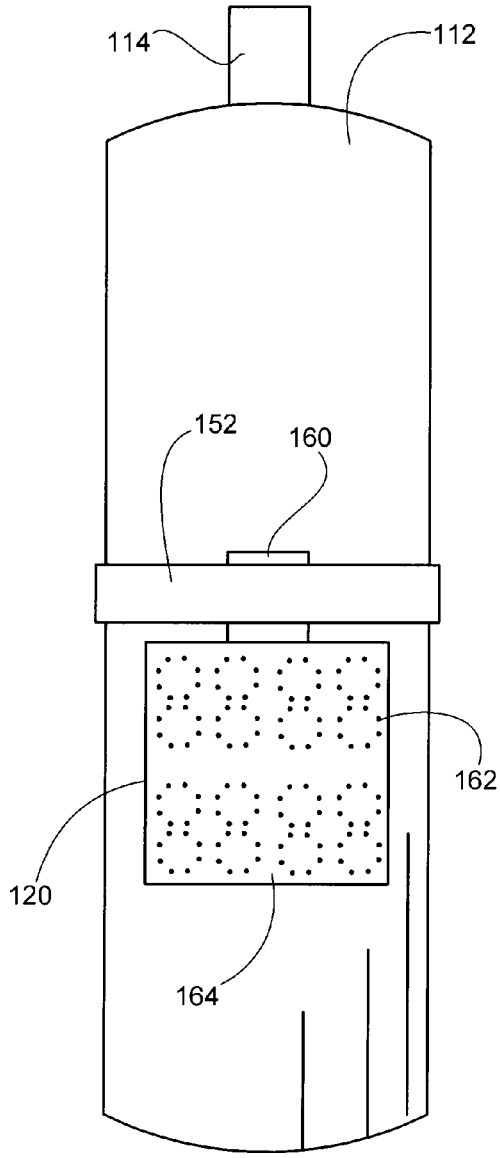

FIG. 5B shows a reversed mounting configuration for the bubbler 120 onto the tank 112. In FIG. 5B, the bubbler 120 is mounted below the strap 152 so as to be rotated 180 degrees as compared to the orientation of FIG. 5A. This arrangement may be suitable for divers who prefer a "higher" placement of the tank to facilitate a more "head down" attitude during diving.

Figure 5C:
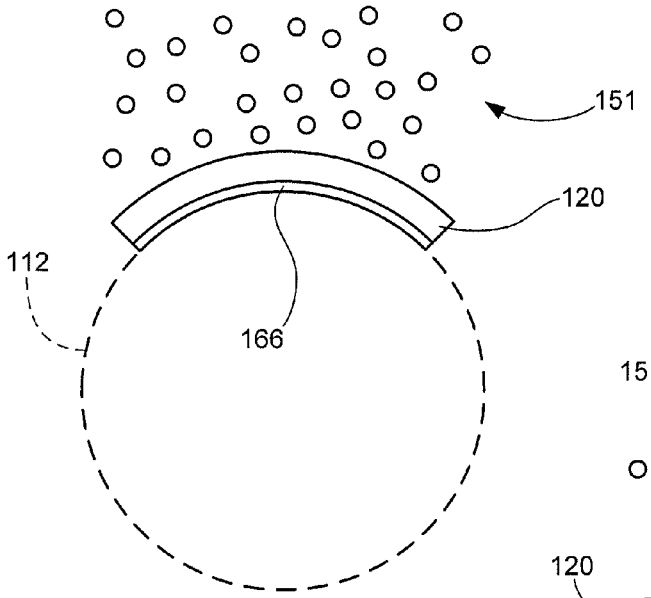

FIG. 5C provides a side elevational depiction of the bubbler 120 in accordance with yet another embodiment. In FIG. 5C, the bubbler housing takes a substantially curvilinear shape to nominally match the cylindrical outer surface of the tank 112. A layer of magnetic material 166 can be used to secure the bubbler 120 to the tank 112. Since many air tanks are made of magnetically permeable metal, the magnetic material 166 allows ease of placement and subsequent removal of the bubbler at any desired location along the tank, while providing sufficient retention force to ensure the bubbler remains in place during the diving session.

Figure 5D:
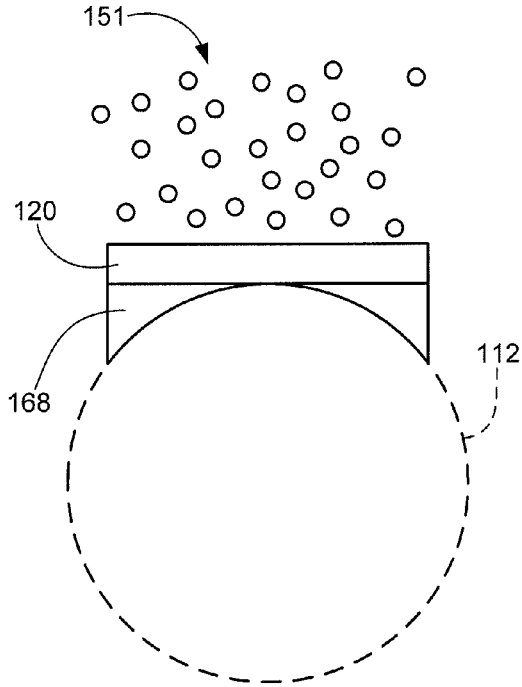
Figure 5E:
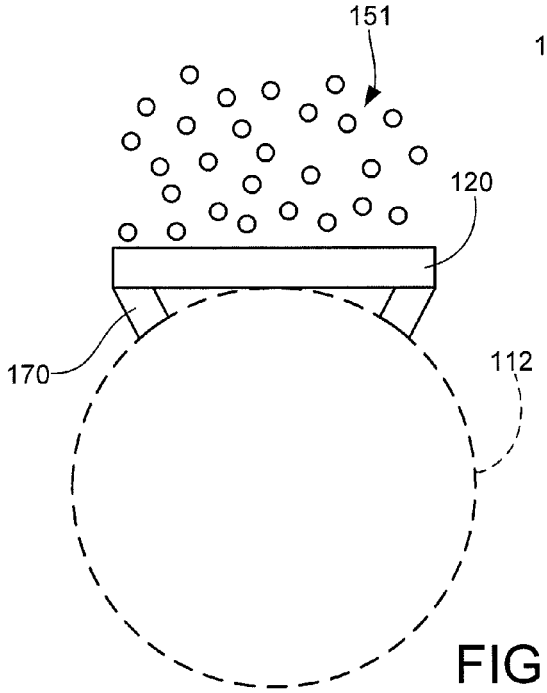

FIG. 5D shows another alternative arrangement for the bubbler 120. In FIG. 5D, the bubbler substantially extends along a linear plane and incorporates a curved support member 168 to contactingly engage the curvilinearly extending outer surface of the tank 112. FIG. 5E shows the use of individual standoffs 170 to contactingly engage the tank 112.

Figure 6:
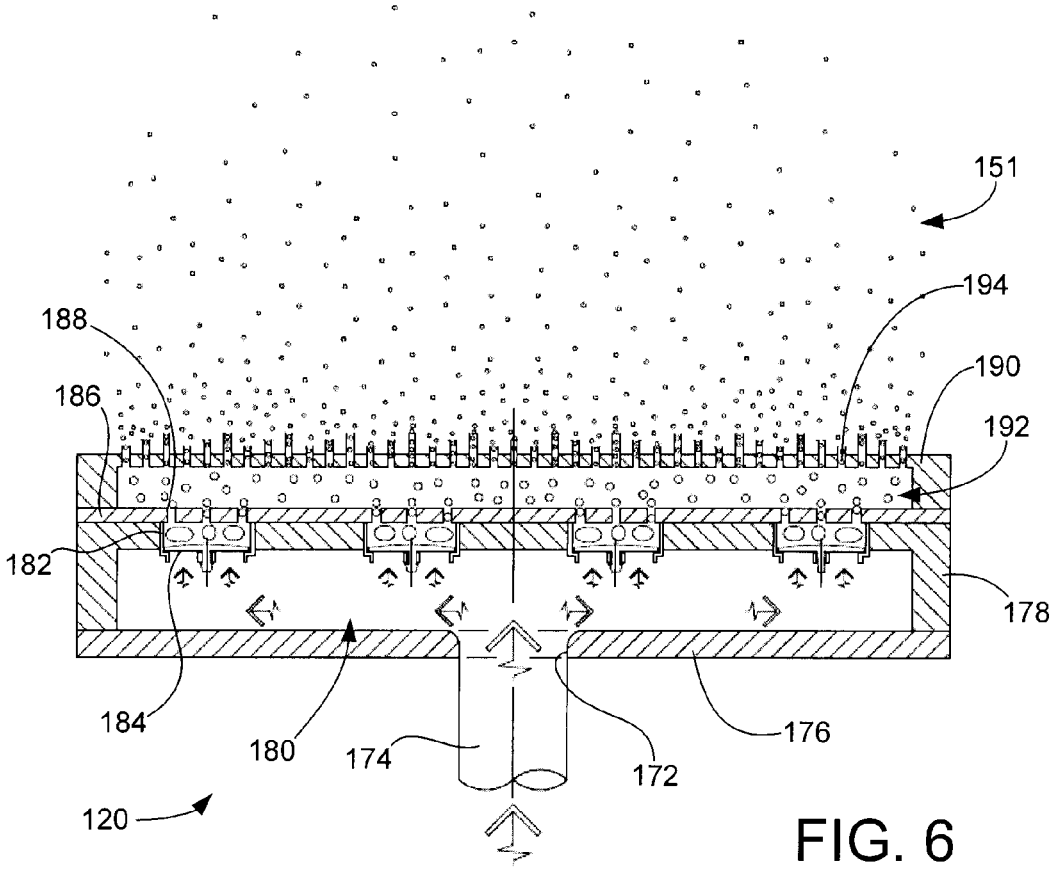
FIG. 6 is a cross-sectional, elevational representation of the bubble diffuser in accordance with some embodiments.

FIG. 6 provides a cross-sectional elevational representation of the interior of the bubbler 120 in accordance with preferred embodiments. The bubbler 120 may be formed from suitable materials such as Plexiglas® acrylic glass or injection molded plastic components that are assembled into a final stacked arrangement. An inlet port 172 accommodates a flow of the exhaust air from the air/water separator 118 (FIG. 4) via a suitable conduit 174. The inlet port 172 extends through a base plate 176 to which is mounted to a tub-shaped member 178 to form a first interior chamber (inlet plenum) 180.

A number of spaced apart ports 182 extend through the tub-shaped member 178 and accommodate individual one-way check valves 184, which may take a similar configuration to that of the main one-way check valve 134 discussed in FIG. 3. Each port 182 will be characterized as a second chamber.

An interior cover plate 186 spans and covers the ports 182 and includes a number of smaller openings (ports) 188 in fluidic communication with the larger ports 182 and valves 184. A second tub-shaped member 190 mates with the interior cover (diffuser) plate 186 to form a third interior chamber (outlet plenum) 192. The second tub-shaped member 190 may further include an array of multiple spaced apart openings (ports) 194, corresponding to the openings 162 previously depicted in FIGS. 5A-5B.

Figure 6A:
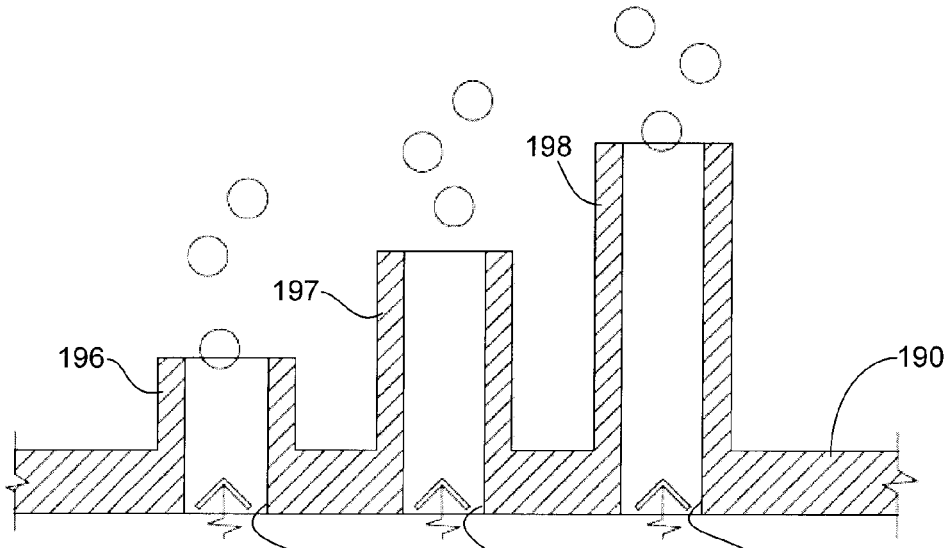
FIG. 6A shows an exit portion of the bubbler of FIG. 6 in greater detail.

As further shown in FIG. 6A, the respective openings 194 may be provisioned with variable length discharge tubes such as 196, 197 and 198. These tubes can be intermixed to help maintain bubble separation as the exhaust air exits the outlet plenum 192.

It has been found through extensive empirical analysis that providing a succession of chambers can provide significant noise reduction. The embodiment of FIG. 6 generally operates to "form bubbles" three different times in succession as the exhaust air passes through the successive chambers.

As noted above, the exhaled air passes through the conduit 174 and into the first chamber 180. The first chamber 180 accumulates the exhaust air from the air/water separator 118 and provides some measure of noise suppression. It will be appreciated that some amount of water may accumulate in the first chamber 180 from time to time, and at other times, the first chamber 180 may be full of air only.

The exhaust air passes from the first chamber 180, through the valves 184 into the second chambers 182 to form relatively large, high energy, low frequency bubbles.

The air from the second chambers 182 pass through the ports 188 into the third chamber as a series of relatively small, low energy, higher frequency bubbles. These bubbles then are further reduced by passing through the diffuser plate portion of member 190 and through the tubes 196, 197 and 198 into the surrounding water as small, low energy, high frequency bubbles, or mist 151. The openings through the tubes 196, 197 and 198 are sized to permit a backflow of water into the chamber 192, and the openings 188 further allow flow of water into the chambers 182. However, the valves 184 are generally configured to restrict flow of water from the second chambers 182 into the first chamber 180. To the extent that water accumulates in the first chamber 180, this water will drain back down the conduit 174 and into the air/water separator 118.

Accordingly, the respective chambers 180, 182 and 192 serve as noise baffling chambers to muffle acoustic noise generated as the exhaust air flows through the bubble diffuser 120. It is contemplated that the energy release in chamber 182 will be further baffled by the air in chamber 180 and the air and water in chamber 192.

The bubbles that pass into the surrounding water will thus have released a substantial amount of energy within the sound chambers and will be close to the ambient bubble energy noise of the water. This will allow the diver to dive with dramatically reduced bubble noise, and allow him to closely approach underwater wildlife without causing a disturbance thereto.

FIGS. 7-12 present a number of alternative configurations for the underwater breathing system discussed above. Like reference numerals will generally be used to identify similar components, and a detailed discussion of previously covered features will be omitted for purposes of brevity.

Figure 7:
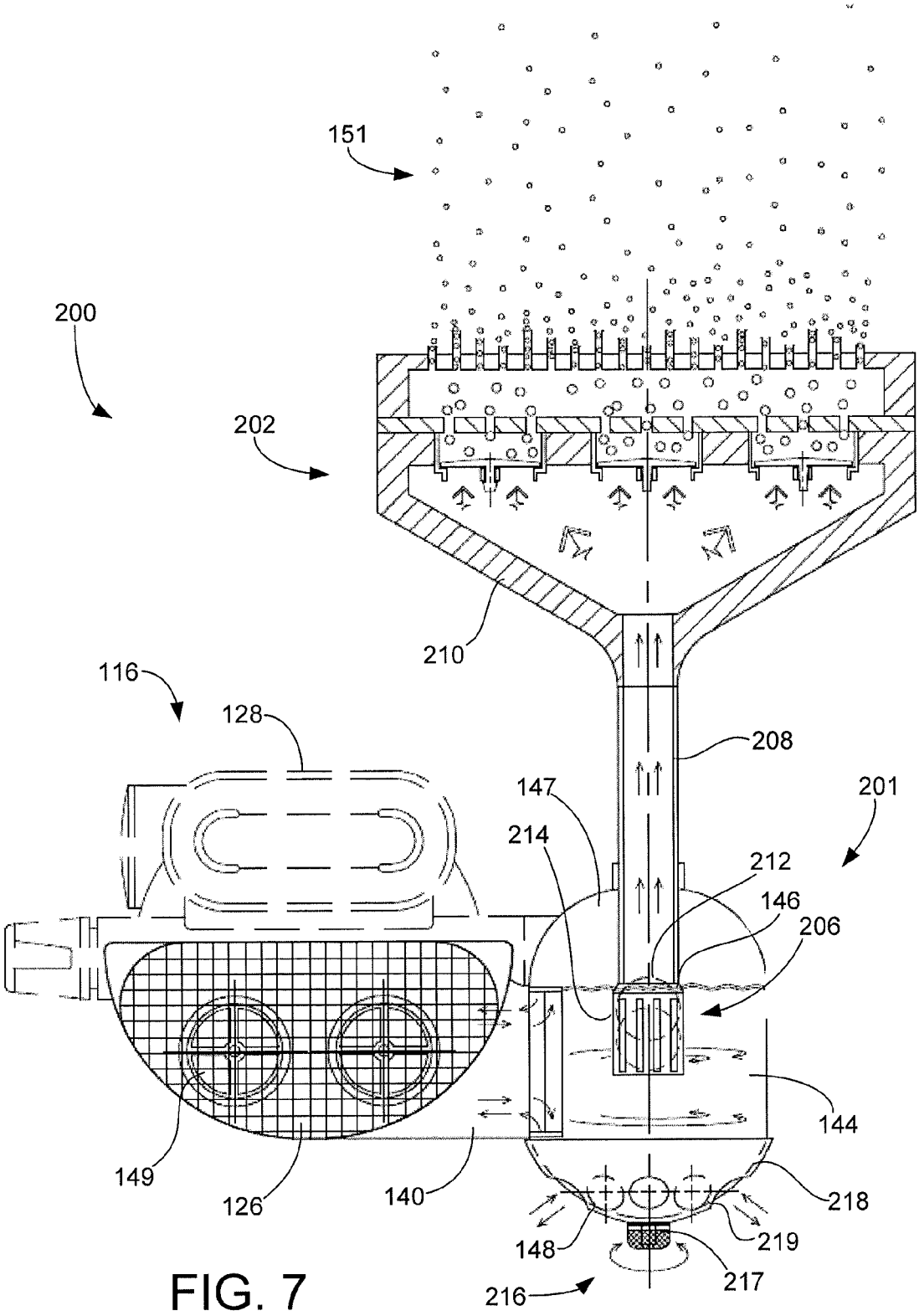
FIG. 7 illustrates an alternative configuration for the breathing system with a bulb-shaped AWS and a snorkel-type bubble diffuser.

FIG. 7 shows a breathing system 200 with the stage-2 regulator 116 affixed to a bulb-shaped air/water separator 201 and a snorkel-type bubbler 202. The air/water separator 201 is generally similar to the separator 118 and includes an interior one-way check valve (stop valve) 206 at the exhaust air outlet port 146. The snorkel-type bubbler 202 operates in a manner generally similar to the bubbler 120 discussed above, but projects above and away from the head of the diver 100 rather than being attached to the air tank 112 on the diver's back.

The snorkel-type bubbler 202 is coupled to the air/water separator 200 by way of a flexible or rigid conduit 208. The conduit may be attached to the strap of the diver's mask (see FIG. 1) as is commonly employed with conventional snorkels. The snorkel-type bubbler assembly 202 can take any suitable shape and may have a frusto-conical (tapered) inlet chamber 210 as shown.

Figure 8:
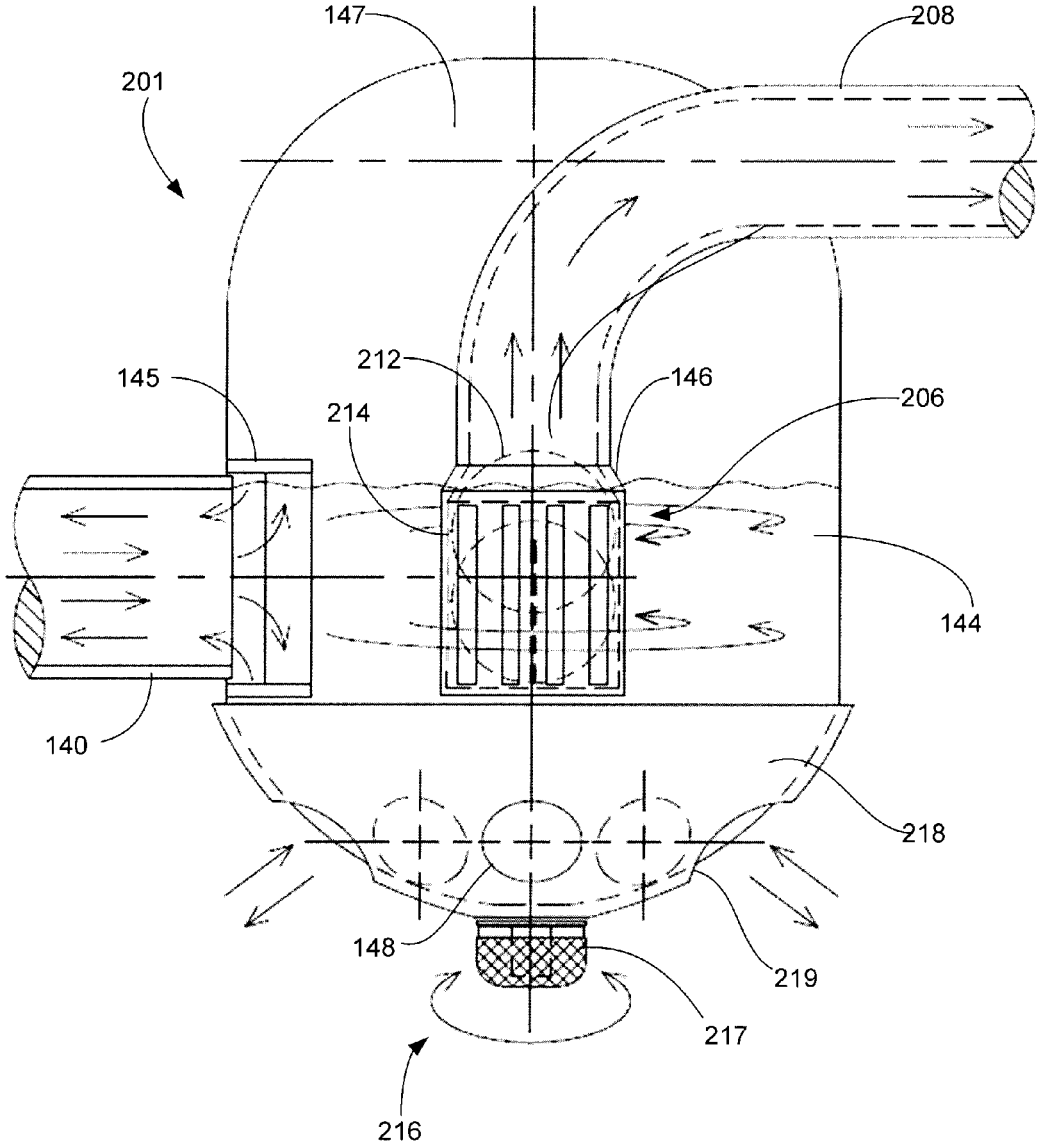
FIG. 8 shows the AWS of FIG. 7 in greater detail.

The air/water separator 201 is shown in greater detail in FIG. 8. The stop valve 206 sealingly engages the air exhaust port 146 when the level of water within the chamber 144 reaches a predetermined level. This prevents the column of exhaust air in the conduit 208 from re-entering the chamber, thereby reducing the effort required by the diver during the next exhale cycle to introduce the next breath of exhaust air into the air/water separator. The exit conduit 208 extends vertically as shown in FIG. 7, or can be routed to the side as in FIG. 8. It is contemplated that water from the air chamber in the bubbler and the interconnecting conduit will be able to freely drain back into the air/water separator when the valve is open.

The stop valve 206 is characterized as a ball valve with a buoyant float 212 captured within a cage 214. Any suitable shape for the float may be used as desired. Other types of check valves can be used, including weighted check valves that rotate within the chamber 144 to effect sealing of the exit port under different rotational orientations.

An adjustment mechanism 216 is mounted to a lower extent of the air/water separator 201. The adjustment mechanism 216 includes a user activated knob 217 which rotates a shroud cover 218 having apertures 219 extending therethrough. These apertures 219 can be controllably aligned relative to the open ports 148 in the air/water separator housing to regulate a rate of flow of water to/from the chamber 144.

Figure 9:
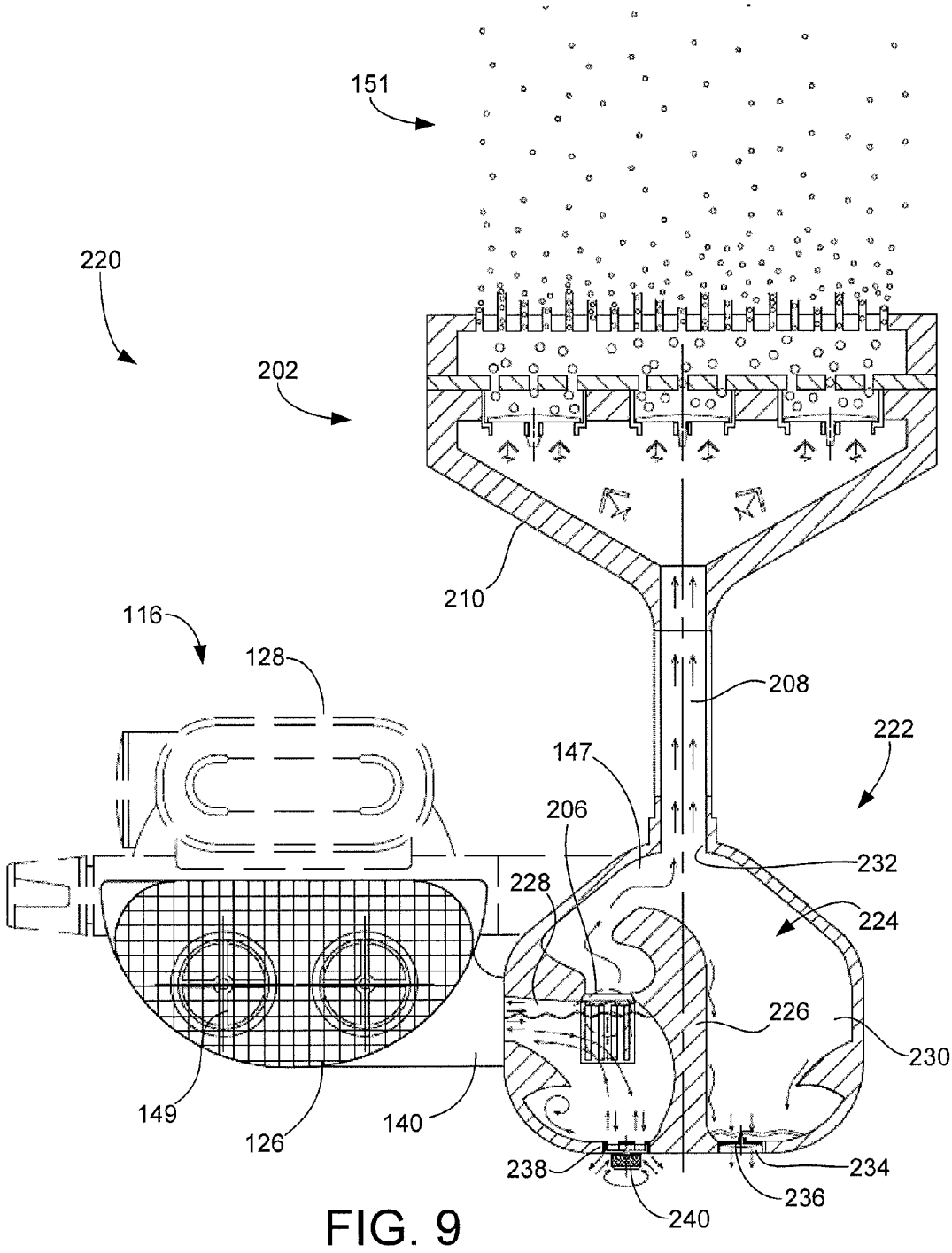
FIG. 9 provides yet another alternative configuration for the breathing system with an s-shaped AWS and the snorkel-type bubble diffuser.

FIG. 9 shows an alternative breathing system 220 with a air/water separator 222 having a substantially s-shaped interior chamber 224 defined by a medial baffle 226. The baffle 226 divides the interior chamber into upstream and downstream portions 228, 230. The aforementioned stop valve 206 is mounted within the upstream portion 228 as shown, although other locations for the valve can be used. The downstream portion 230 may be configured to provide an air entrapment region 147 to temporarily entrap air separated from the inlet mixture prior to flowing to the bubbler.

Figure 10:
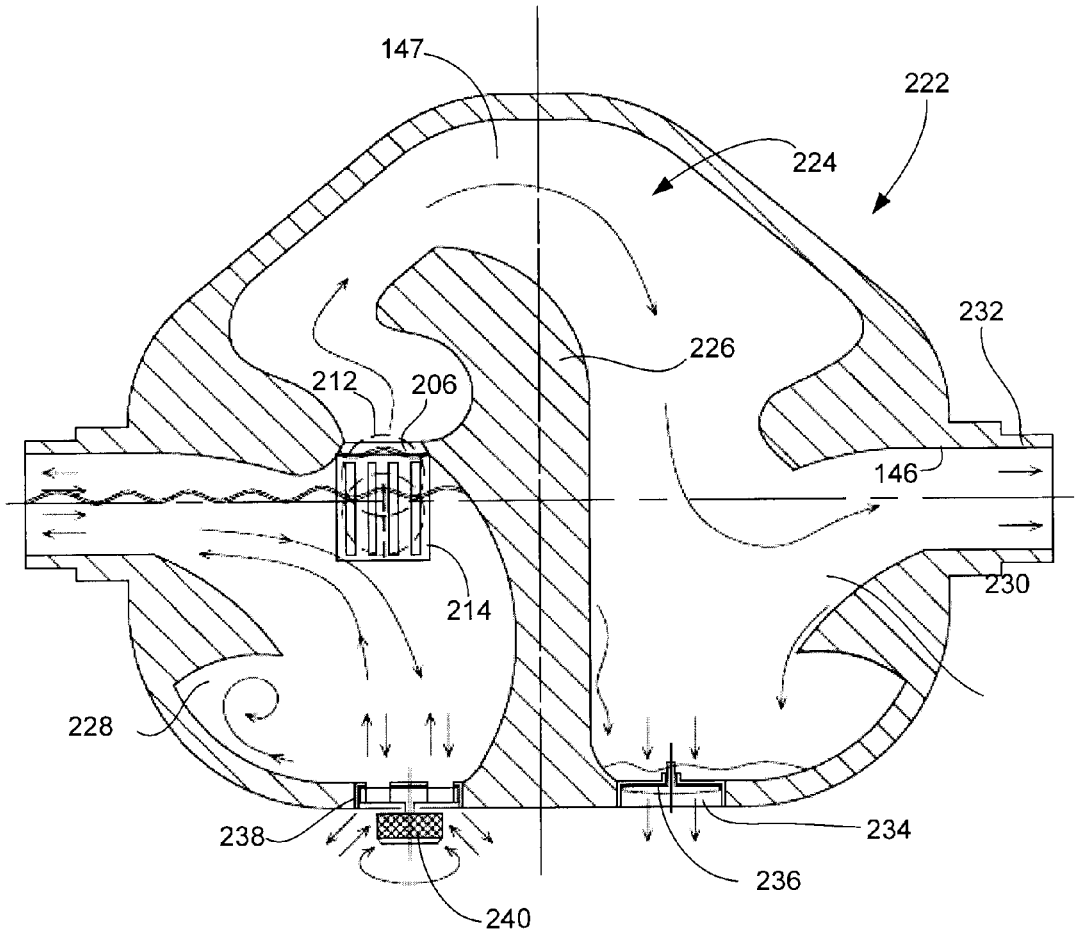
FIG. 10 depicts the AWS of FIG. 9 in greater detail.

Various interior sidewall contours operate as flow baffles to facilitate the efficient separation and exit of exhaust air out exhaust air port 232 and the flow of water out of exhaust water port 234. The exhaust water port 234 includes a one-way check valve 236 to prevent back flow of water into the downstream portion 230. A two-way normally open water flow port 238 with adjustment mechanism 240 allows controlled regulation of water into and out of the upstream portion 228. FIG. 10 shows the air/water separator 222 of FIG. 9 in greater detail with a side-mounted exit port 232.

Figure 11:
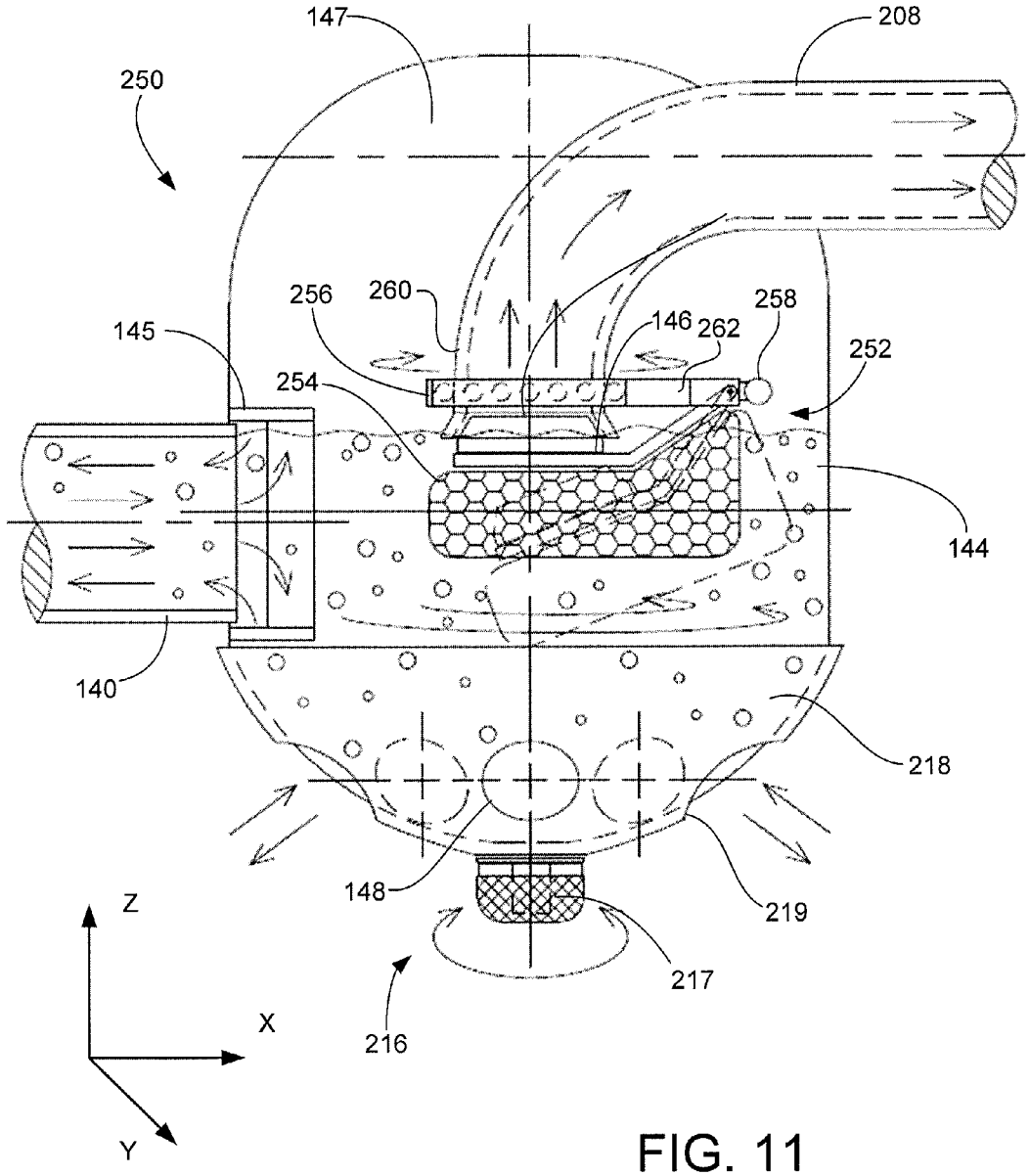
FIG. 11 shows another alternative configuration for the AWS.

FIG. 11 illustrates another air/water separator 250 generally similar to the separator 201 of FIGS. 7-8. The separator 250 includes an interior check valve 252 having a buoyant flapper member 254 coupled to a swivel ring 256 by a hinge 258. The flapper member is formed from a suitable buoyant material such as a closed cell foam and is configured to form a water-tight seal against the air exit port 146 when the water in the interior chamber 144 of the air/water separator 250 reaches or exceeds a predetermined level. The swivel ring 256 allows the flapper member 254 to freely rotate a full 360 degrees around a neck portion 260 of conduit 208 that extends into the chamber 144. This allows the flapper member 254 to seal against the outlet port 146 over a large range of pitch and tilt angles for the separator 250. The check valve 252 is weighted such as by the use of an incorporated weight 262 adjacent the hinge 258 to ensure the flapper swivels down as the separator 250 is manipulated under different operational conditions such as those shown in FIGS. 11A-11D. For reference, orthogonal X, Y and Z axes are represented in FIG. 11.

Figure 11A:
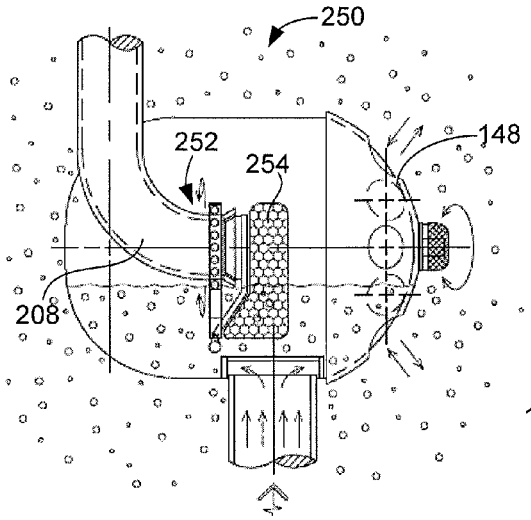
FIGS. 11A-11D show the AWS of FIG. 11 under different operational conditions and attitudes.
Figure 11C:
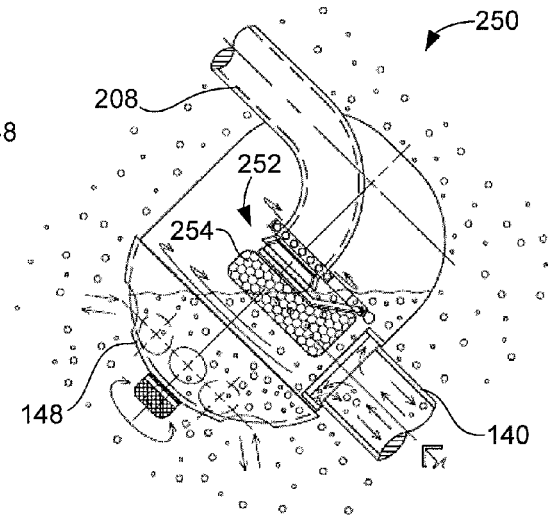
Figure 11B:
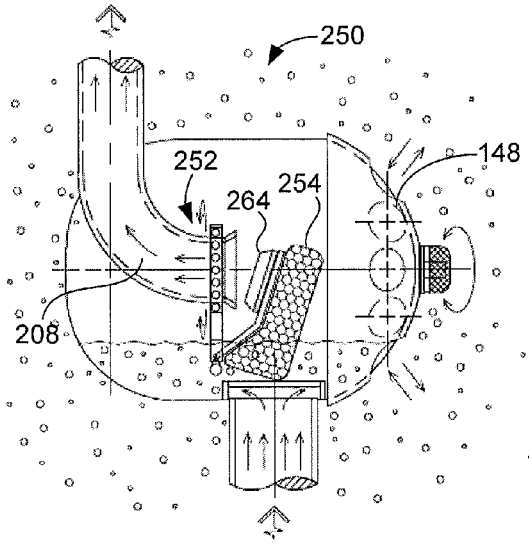

FIGS. 11A and 11B show the separator 250 in an orientation that is rotated 90 degrees counterclockwise about the Y-axis as compared to the orientation of FIG. 11. The flapper member 254 will have swiveled 180 degrees about the Z-axis during this time. In FIG. 11A, the water level within the separator 250 is sufficiently high to close the flapper member 254, whereas the flapper member 254 is open in FIG. 11B. FIG. 11B thus represents an exhale event during which the diver is exhaling spent air.

The exhaled air displaces a portion of the water within the chamber through ports 148, allowing the flapper member 254 to move to the open position. It is noted that a portion of the air within the chamber exits through the exposed aperture ports 148 in both FIGS. 11A and 11B, forming a small mist of bubbles surrounding the separator 250. An elastomeric stopper member 264 shown in FIG. 11B insertingly engages the end of the conduit 208 as shown.

Figure 11D:
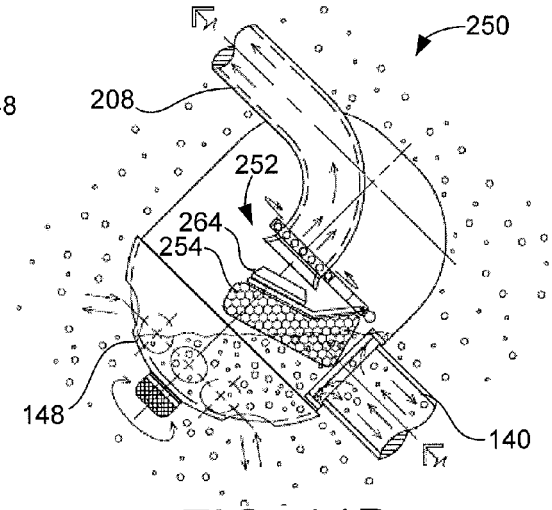

FIGS. 11C and 11D show the separator 250 in an orientation that is rotated 135 degrees clockwise with respect to the orientation of FIG. 11. As before, FIG. 11C shows the valve 252 in a closed position, whereas FIG. 11D shows the valve 252 in an open position.

The breathing system as variously embodied herein operates to regulate the respiration of the diver 100 under different diving conditions. With reference again to FIG. 1, the diver 100 is shown to be in a normal, substantially horizontal diving attitude with the air/water separator 116 at a first depth and the bubbler 120 being at a second, reduced depth. The surrounding water pressure at the air/water separator is denoted as $P_{aws}$, and the water pressure at the bubbler 120 is denoted as $P_b$.

While the elevational depth between these two components may be only a few inches, those skilled in the art will nevertheless recognize that the pressure $P_{aws}$ may be significantly greater than the pressure $P_b$ ($P_{aws}>P_b$). Under these conditions, the exhaust air from the diver 100 will easily pass through the air/water separator 118 and bubbler 120 to the surrounding water, since the exhaust air will normally flow to the lowest available pressure region within the system.

Figure 12:
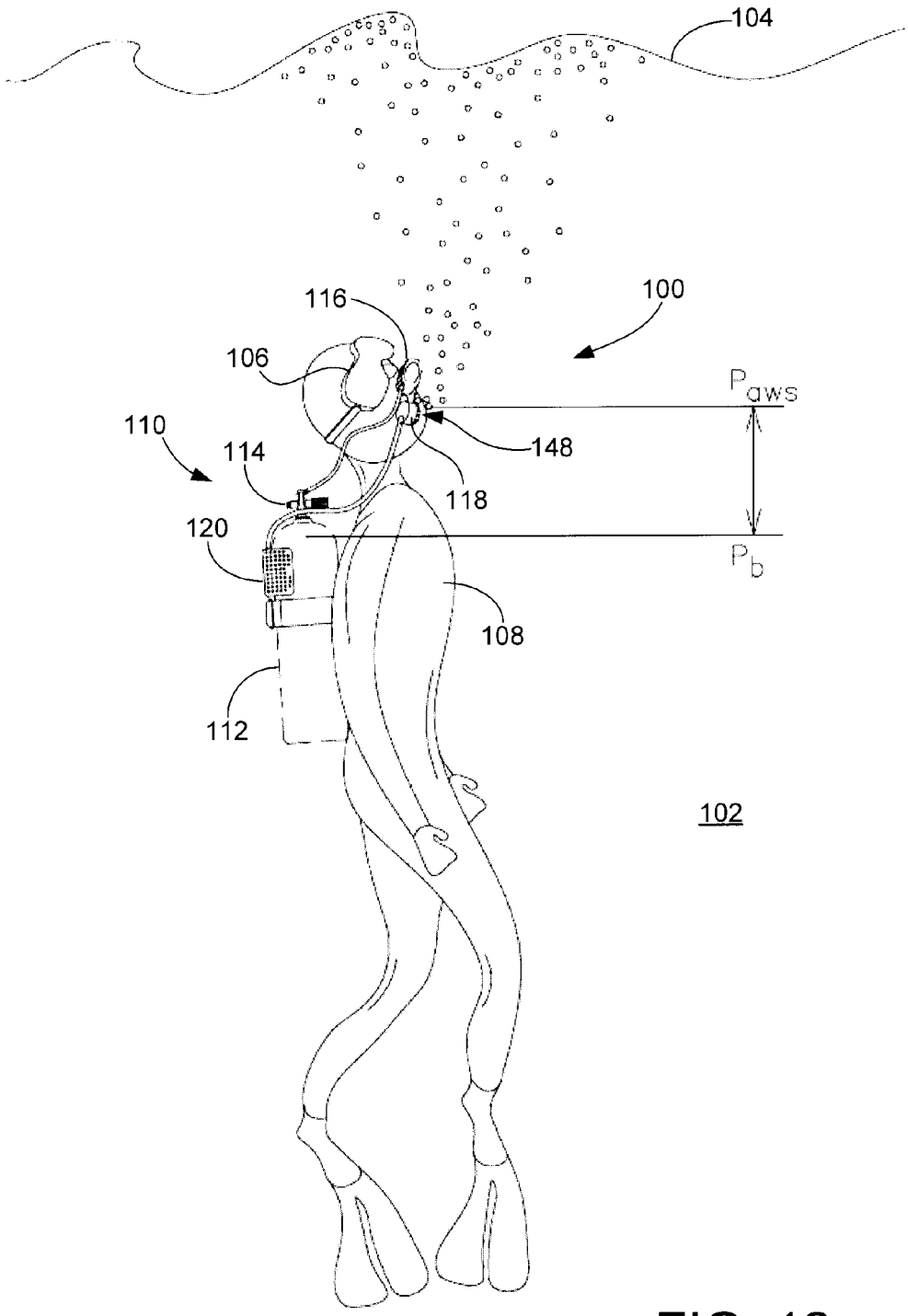
FIG. 12 generally illustrates the diver of FIG. 1 in a vertically upward orientation.

FIG. 12 shows the diver 100 in an upright orientation, such as when the diver is swimming to the surface 104 at the conclusion of a diving session. Under these circumstances, $P_{aws}$ will tend to be less than $P_b$ ($P_b>P_{aws}$). The exhaust air will thus primarily exit the exhaust ports 148 of the lower pressurized air/water separator 118, rather than through the higher pressurized bubbler 120. The diver will still be able to breathe easily, and it is contemplated that the exiting bubbles, while adjacent the diver's head, will not obscure the diver's vision as he swims upwardly.

Figure 13:
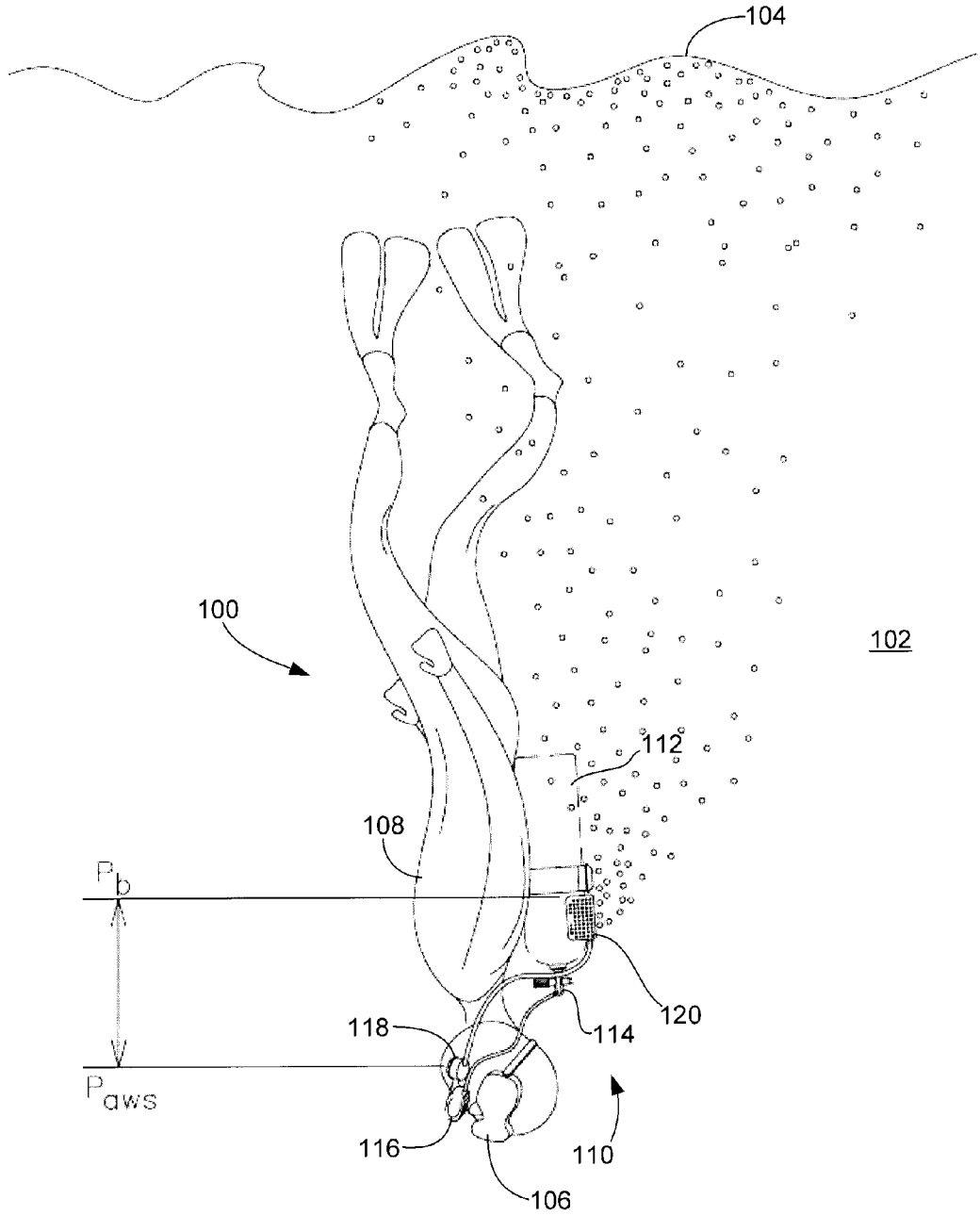
FIG. 13 generally illustrates the diver in a vertically downward orientation.

FIG. 13 shows the diver in a downward orientation, such as when the diver is beginning a diving session and is maneuvering to a lower depth. As in FIG. 1, the pressure $P_{aws}$ will tend to be greater than the pressure $P_b$, and the exhaust air will be directed through the bubbler 120 to the surrounding water.

Figure 14:
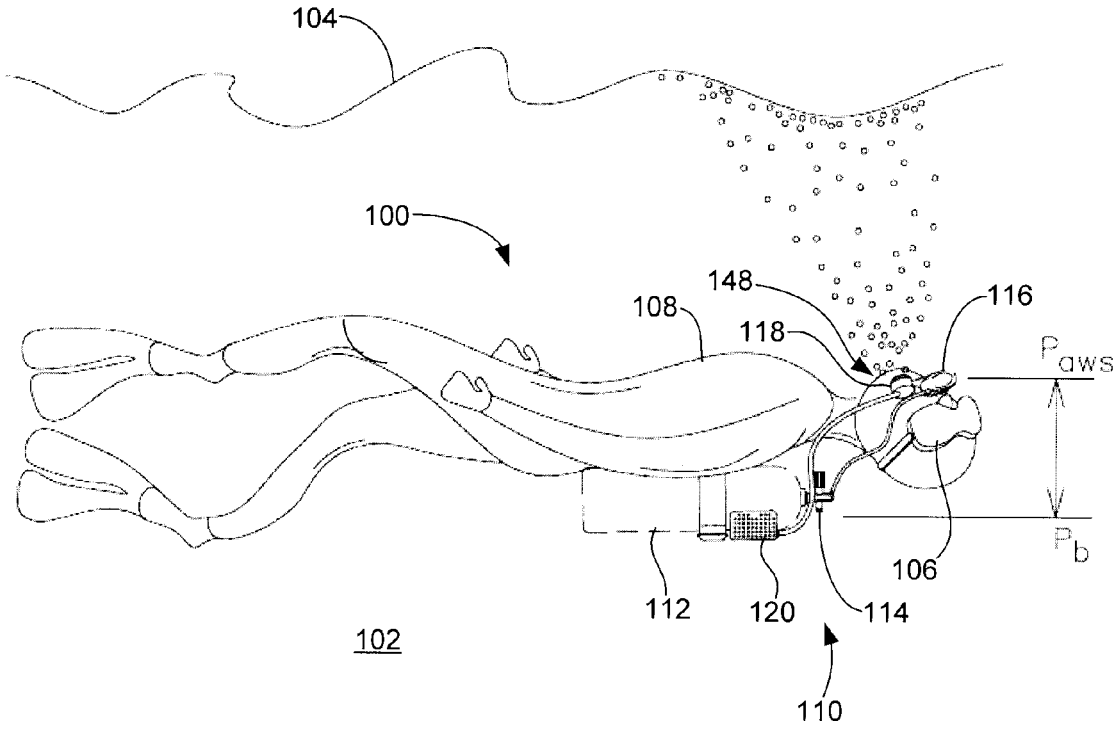
FIG. 14 shows the diver in an upside down orientation.

Finally, FIG. 14 shows the diver in a substantially horizontal, inverted orientation. While uncommon, the diver may choose this orientation for a number of reasons such as to swim under an obstruction or to observe overhead wildlife. As with the orientation of FIG. 12, $P_b > P_{aws}$ and the exhaust air will tend to exit the air/water separator 118 rather than the bubbler 120. It is contemplated that the diver's respiration efforts will be otherwise substantially unaffected while in this orientation, and the bubbles will flow upwardly and away from the vicinity of the diver's head.

It will now be appreciated that the various embodiments disclosed herein can provide a number of benefits. The use of a air/water separator as embodied herein generally enables exhaust air to be separated from exhaust water and directed to a suitable location away from the diver's face and ears, while allowing sufficient back flow of water to the exhaust chamber to ensure free-flow conditions are avoided.

While not required, a bubble diffuser can be utilized to break up large volumes of the exhaust air into a smaller mist or array of bubbles, reducing noise that could scare away underwater wild life, and allowing the diver to not be visually or audibly distracted by the exhausted air.

The system as embodied herein can be mounted to an existing stage-2 regulator or can be incorporated into a new regulator design. The size and shape of the air/water separator can vary and can be made relatively small while still providing sufficient chamber space to handle the expected volumes of exhaust air and to provide a sufficient volume of water back to the stage-2 regulator to close the one-way check valve therein. The use of a check valve within the air/water separator can further provide ease of use even when the diver undergoes changes of depth and/or orientation between breaths.

It will be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed. For example, the particular elements may vary depending on the particular application without departing from the spirit and scope of the claimed invention.

What is claimed is:

1. An apparatus for use during open system underwater diving, comprising:

an air supply which provides a supply of air along a supply conduit;

a regulator adapted for engagement with a diver's mouth to receive air from the supply conduit during an inhale cycle and to direct a mixture of water and exhaust air away from the diver along an exhaust conduit during an exhale cycle, wherein the regulator comprises an air chamber and an exhaust chamber separated by a one-way stop valve, wherein water pressure in the exhaust chamber closes the stop valve during said inhale cycle and wherein the stop valve opens during an exhale cycle so that said mixture of exhaust air and water flow out a port of said exhaust chamber;

an air/water separator coupled to the exhaust conduit which separates the exhaust air from the water in said mixture and directs the separated exhaust air along an exhaust air conduit; and a bubble diffuser coupled to the exhaust air conduit which passes the separated exhaust air as a fine mist of bubbles into the surrounding water, the bubble diffuser located on a tank of the air supply adapted to be mounted to a back of the diver.

2. The apparatus of claim 1, wherein the bubble diffuser is coupled to the tank via a hinge assembly so that the diffuser rotates relative to the tank.

3. The apparatus of claim 1, wherein the regulator further comprises an inlet pressure differential actuated valve to establish a crack pressure at which inlet air is admitted to the air chamber.

4. The apparatus of claim 1, wherein the air/water separator comprises a body which defines an interior separation chamber, an inlet conduit coupled to the body to receive the mixture of water and exhaust air, an exhaust air outlet to accommodate a flow of at least a portion of the separated exhaust air, a water outlet through which at least a portion of the water flows from the mixture, and a stop valve which respectively opens and closes the exhaust air outlet responsive to a relative level of water within the interior separation chamber.

5. The apparatus of claim 4, wherein the stop valve comprises a buoyant flapper valve configured to swivel about a conduit coupled to the exhaust air outlet.

6. The apparatus of claim 4, wherein the air outlet comprises a projecting conduit which extends a selected distance into a medial portion of the separation chamber to define an air entrapment region adjacent thereto to temporarily entrap a portion of the separated exhaust air.

7. The apparatus of claim 4, wherein the separation chamber forms a substantially s-shaped entrapment region to temporarily entrap a portion of the separated exhaust air.

8. The apparatus of claim 1, wherein the bubble diffuser comprises a plurality of noise baffling chambers through which the exhaust air successively passes.

9. An apparatus, comprising:

an air supply which provides a supply of air along a supply conduit;

a regulator adapted for engagement with a diver's mouth to receive air from the supply conduit during an inhale cycle and to direct a mixture of water and exhaust air away from the diver along an exhaust conduit during an exhale cycle, the regulator comprising an air chamber and an exhaust chamber separated by a check valve, wherein water pressure in the exhaust chamber closes the check valve during the inhale cycle and wherein the check valve opens during the exhale cycle so that the mixture of exhaust air and water flows out a port of the exhaust chamber; and an air/water separator coupled to the exhaust conduit which separates the exhaust air from the water in said mixture and directs the separated exhaust air along an exhaust air conduit.

10. The apparatus of claim 9, in which the check valve is characterized as a first check valve, and the apparatus further comprises a second check valve coupled to the exhaust chamber adapted to remain closed during the exhale cycle and to immediately open at the end of the exhale cycle to permit a back flow of water into the exhaust chamber to facilitate a transition of the first check valve from an open position to a closed position.

11. The apparatus of claim 10, in which the second check valve is mounted to an attachment conduit between the regulator and the air/water separator.

12. The apparatus of claim 10, in which the second check valve forms a portion of the regulator.

13. The apparatus of claim 9, further comprising an adaptor conduit which connects the air/water separator to the regulator and directs the mixture of exhaust air and water from the port of the exhaust chamber to an inlet port of the air/water separator, the adaptor conduit removeably attachable to the regulator so that the regulator can be used by the diver without the air/water separator in which case the mixture of exhaust air and water instead flows out the port of the exhaust chamber and into the surrounding water adjacent the head of the diver.

14. The apparatus of claim 9, further comprising an adaptor conduit which connects the air/water separator to the regulator and directs the mixture of exhaust air and water from the port of the exhaust chamber to an inlet port of the air/water separator, the adaptor conduit permanently attached to the regulator so as to be integrally formed therewith as a single unit.

15. The apparatus of claim 9, in which the air/water separator comprises a body which defines an interior separation chamber, an inlet conduit coupled to the body to receive the mixture of water and exhaust air, an exhaust air outlet which accommodates a flow of at least a portion of the separated exhaust air, a water outlet through which at least a portion of the water flows from the mixture, and a stop valve which respectively opens and closes the exhaust air outlet responsive to a relative level of water within the interior separation chamber.

16. An apparatus comprising:

an air supply which provides a supply of air along a supply conduit;

a regulator adapted for engagement with a diver's mouth to receive air from the supply conduit during an inhale cycle and to direct a mixture of water and exhaust air away from the diver along an exhaust conduit during an exhale cycle;

an air/water separator coupled to the exhaust conduit which separates the exhaust air from the water in said mixture and directs the separated exhaust air along an exhaust air conduit; and an exterior check valve coupled to the regulator adapted to remain closed during the exhale cycle and to immediately open at the end of the exhale cycle to permit a back flow of water into the regulator.

17. The apparatus of claim 16, in which the regulator comprises an air chamber and an exhaust chamber separated by a main check valve, wherein the main check valve opens during the exhale cycle so that the mixture of exhaust air and water flows out a port of the exhaust chamber to the air/water separator, and wherein the back flow of water into the regulator from the exterior check valve closes the main check valve at the conclusion of the exhale cycle.

18. The apparatus of claim 16, in which the regulator comprises a main housing wall with a flow-through aperture and the exterior check valve is affixed to the main housing wall to selectively seal and open the flow-through aperture.

19. The apparatus of claim 16, in which the air/water separator comprises a main body and a swivel, the swivel coupled to the regulator via a conduit to facilitate rotation of the main body relative to the regulator so as to maintain the air/water separator in a substantially upright orientation irrespective of an orientation of the regulator.

20. An apparatus comprising a regulator comprising a mouthpiece adapted for insertion into a diver's mouth to receive air from a supply conduit during an inhale cycle and to direct a mixture of water and exhaust air away from the diver along an exhaust conduit during an exhale cycle, the regulator further comprising a body forming an air chamber and an exhaust chamber separated by an internal check valve, wherein water pressure in the exhaust chamber closes the internal check valve during the inhale cycle and wherein the internal check valve opens during the exhale cycle so that the mixture of exhaust air and water flows out the exhaust conduit from the exhaust chamber, the regulator further comprising an external check valve connected to the body between the exhaust chamber and a surrounding volume of water, the external check valve adapted to facilitate an inrush of water from the surrounding volume of water into the exhaust chamber at the conclusion of the exhale cycle to ensure closure of the internal check valve.

21. The apparatus of claim 20, further comprising an air/water separator coupled to the exhaust conduit which separates the exhaust air from the water in said mixture and directs the separated exhaust air along an exhaust air conduit.

22. The apparatus of claim 21, further comprising a bubble diffuser coupled to the exhaust air conduit which passes the separated exhaust air as a fine mist of bubbles into the surrounding water, the bubble diffuser located on an air supply tank adapted to be mounted to a back of the diver.

* * * * *